United States Patent [19]

Muller

[11] 4,097,023

[45] Jun. 27, 1978

[54] ROPE CLAMPING ARRANGEMENTS FOR SAILBOATS OR OTHER APPLICATIONS

[75] Inventor: Werner Muller, Aarau, Switzerland

[73] Assignee: Mubir AG fur Maschinen-und Apparatebau, Switzerland

[21] Appl. No.: 721,384

[22] Filed: Sep. 8, 1976

[30] Foreign Application Priority Data

| | | |
|---|---|---|
| Sep. 12, 1975 | Switzerland | 12086/75 |
| Dec. 16, 1975 | Switzerland | 16321/75 |

[51] Int. Cl.[2] ..... B66D 5/16

[52] U.S. Cl. ..... 254/156; 24/134 R; 188/65.1; 254/164; 24/134 KB

[58] Field of Search ..... 254/164, 156, 191; 188/65.1, 65.4, 166; 182/5, 6, 7; 24/134 R, 134 KA, 134 KB, 134 KC, 134 KD, 134 L, 134 M

[56] References Cited

U.S. PATENT DOCUMENTS

| | | | |
|---|---|---|---|
| 887,344 | 5/1908 | Nelson | 188/65.1 |
| 1,033,311 | 7/1912 | Gilloon et al. | 254/156 |
| 1,709,910 | 4/1929 | Gray | 188/65.1 X |
| 1,956,903 | 5/1934 | Kline | 24/134 R |
| 2,867,020 | 1/1959 | Lefebvre | 24/134 R |
| 2,867,875 | 1/1939 | Davison | 24/134 R X |
| 3,186,372 | 6/1965 | Cleveland | 114/199 |
| 3,765,061 | 10/1973 | Nash | 24/134 CP |
| 3,770,244 | 11/1973 | McCloud | 254/164 |

FOREIGN PATENT DOCUMENTS

| | | |
|---|---|---|
| 599,053 | 3/1948 | United Kingdom. |

*Primary Examiner*—Drayton E. Hoffman
*Assistant Examiner*—Donald W. Underwood
*Attorney, Agent, or Firm*—Ostrolenk, Faber, Gerb & Soffen

[57] ABSTRACT

In a block for a rope or sheet: a pulley over which the rope moves, an eccentric cam which is pivotable to selectively clamp or release the rope against the pulley and a pivotably lever to which the cam is connected such that motion of the lever pivots the cam between its clamping and releasing position; bearing means to enable pivoting of the lever away from the cam clamping position; a spring to at least return the cam to its clamping position.

3 Claims, 12 Drawing Figures

ROPE CLAMPING ARRANGEMENTS FOR SAILBOATS OR OTHER APPLICATIONS

BACKGROUND OF THE INVENTION

The present invention concerns apparatus for clamping a rope. A preferred application for the invention is in connection with securing the ropes or sheets on a sailboat, although the invention is not limited to this particular application.

When it is desired to change the direction of a rope or to reduce the line tension on a rope or to affect the mechanical advantage of the force that must be exerted upon the rope (block and tackle action), the rope is led through a roller or pulley assembly that is supported in a block. The portion of the rope on the exit side of the block and which is not normally tensioned is the hauling portion. Means are provided to give the person who is pulling upon the rope or sheet access to the hauling portion of the rope.

DESCRIPTION OF THE PRIOR ART

For holding and securing a rope or sheet, a device called a Curry clamp is now often used. This device includes two opposed eccentric cams that are spring biased to both squeeze against the rope or sheet. The self clamping eccentric cams are rotated free of their grip upon the rope by an operator hauling on the rope, and they engage the rope when hauling on the rope ceases and the rope returns or slackens. Usually, such clamps are positioned just past the exit from the last roller or pulley of the block at the hauling part of the rope.

To tighten or haul a rope or sheet held by a Curry clamp, an operator simply pulls on the hauling portion of the rope or sheet until the clamp releases the rope. When the rope has been tightened enough, the operator simply releases the hauling portion of the rope and the slight slackening or return of the rope rotates the eccentric cams in engagement therewith to their respective locking positions, thereby preventing the rope from slackening further.

To slacken or ease away the rope or sheet that is held by the Curry clamp, the rope must first be hauled slightly until the clamping eccentric cams are released. Next, a sidewards jerk upon the rope or sheet is needed to remove the rope from between the clamping cams. After the rope has been permitted to slacken to a desired extent, the rope must again be reinserted between the clamping eccentric cams by a sideward pull and a brief hauling to open the eccentric clamping cams to receive the rope. The rope is then released and the slight further slackening or returning of the rope will cause the cam elements to reengage the rope.

On larger sailboats, racing yawls or the like, the helmsman is often at a great distance from the block holding a sheet, and the block may not even be within his field of view. Rapid releasing or easing away of the sheet may be necessary, particularly in a storm and in other emergency situations. The easing away of a sheet held by a Curry clamp is often not done promptly and properly. On such occasions, the sail may become out of control and the boat may even capsize.

A clamp is needed for being associated with the rollers or pulleys about which a rope or sheet passes. This clamp must be releasable by a simple pull on the hauling portion of the rope or sheet. The rope or sheet should be able to be released or slackened, without having to be completely removed from the clamp.

A clamp of this type is already known. In this clamp, two opposed eccentric cams are moved apart by a swiveling lever. The lever is swiveled to separate the cams through a sideways pull on the hauling part of the rope. This clamp requires a large space for its operation, to accommodate the swiveling of the lever. This makes it particularly unsuitable for clamping the main sheet of a sailboat. Further, the swiveling of the lever under the influence of the motion of the hauling part of the rope or sheet is rather slow, and too great a length of the hauling part of the rope or sheet must be pulled until the lever separates the cams.

In another known clamping arrangement, an eccentric cam presses the rope or sheet into the groove of the roller or pulley. This rather compact arrangement is not used for the sheets of sailboats because the standard construction of the block for the rollers or pulleys around which the rope or sheets pass does not permit a sideways release of the sheet from the clamp. Further, the reinsertion of the sheet under racing conditions, where great operator speed is needed, would be impossible with a sidewise opening.

SUMMARY OF THE INVENTION

The clamp of the present invention comprises an eccentric cam which is normally spring biased to have its bearing surface press the rope or sheet being clamped securely against first bearing means, comprising, for example, a stationary roller or pulley. The cam is mounted on a pivotable lever, and the lever is pivotable around an axis parallel to the axis of the first bearing means, to move the cam into and out of engagement with the rope or sheet, thereby permitting tightening or slackening of the rope. The hauling portion of the rope engages the lever, and particularly engages second bearing means on the lever, comprising for example a roller, pulley, or the like. When the hauling portion of the rope is pulled, it causes the lever to pivot so as to release the cam from the rope or sheet. When the force on the hauling portion is released, a biasing spring returns the cam into engagement with the rope or sheet and the lever returns to its previous position. The return spring may be a unidirectional biasing spring or may be an overcenter spring which forces the cam to its opposite terminal position.

The lever engages the cam for moving the cam as described. In a first embodiment, the cam is attached on the lever and pivots with the lever. In a second embodiment, the cam is separate from the lever and there is means on the lever that moves with the lever and that engages the cam for causing it to shift. The cam and lever may pivot around a common axis or around respective separated axes, with the first alternative being more usual with the first embodiment and the second alternative being more usual with the second embodiment. Where the pivot axes of the lever and the cam are separated, the pivot axis of the lever and the separate pivot axis of the cam can be so located with respect to each other and the relative lengths of the pivot arm of the cam and the pivot arm of the device on the lever that moves the cam can be selected so that a relatively small angle of pivot of the lever will result in a relatively large angle of pivot of the cam.

Accordingly, it is the primary object of the present invention to clamp a rope or sheet that passes around a bearing surface, such as a roller, pulley or the like.

It is another object of the invention to provide clamping means, which permit easy release of the rope or sheet when it is desired to release or slacken it.

It is a further object of the invention to provide such clamping means, which do not occupy much additional space during operation, beyond their original size.

It is yet another object of the invention to provide such clamping means, which permits both the clamping and the releasing of the rope or sheet without having to move the rope or sheet sideways to its direction of extension or out from between the clamping elements.

It is a further object of the invention to provide means for clamping or securing the sheet of a sailboat.

These and other objects and features of the invention will become apparent from the following description of the accompanying drawings.

DETAILED DESCRIPTION OF THE PREFERRED EMBODIMENTS

Four embodiments of the invention are described. In each embodiment, elements corresponding in function are correspondingly numbered.

Figure 1:
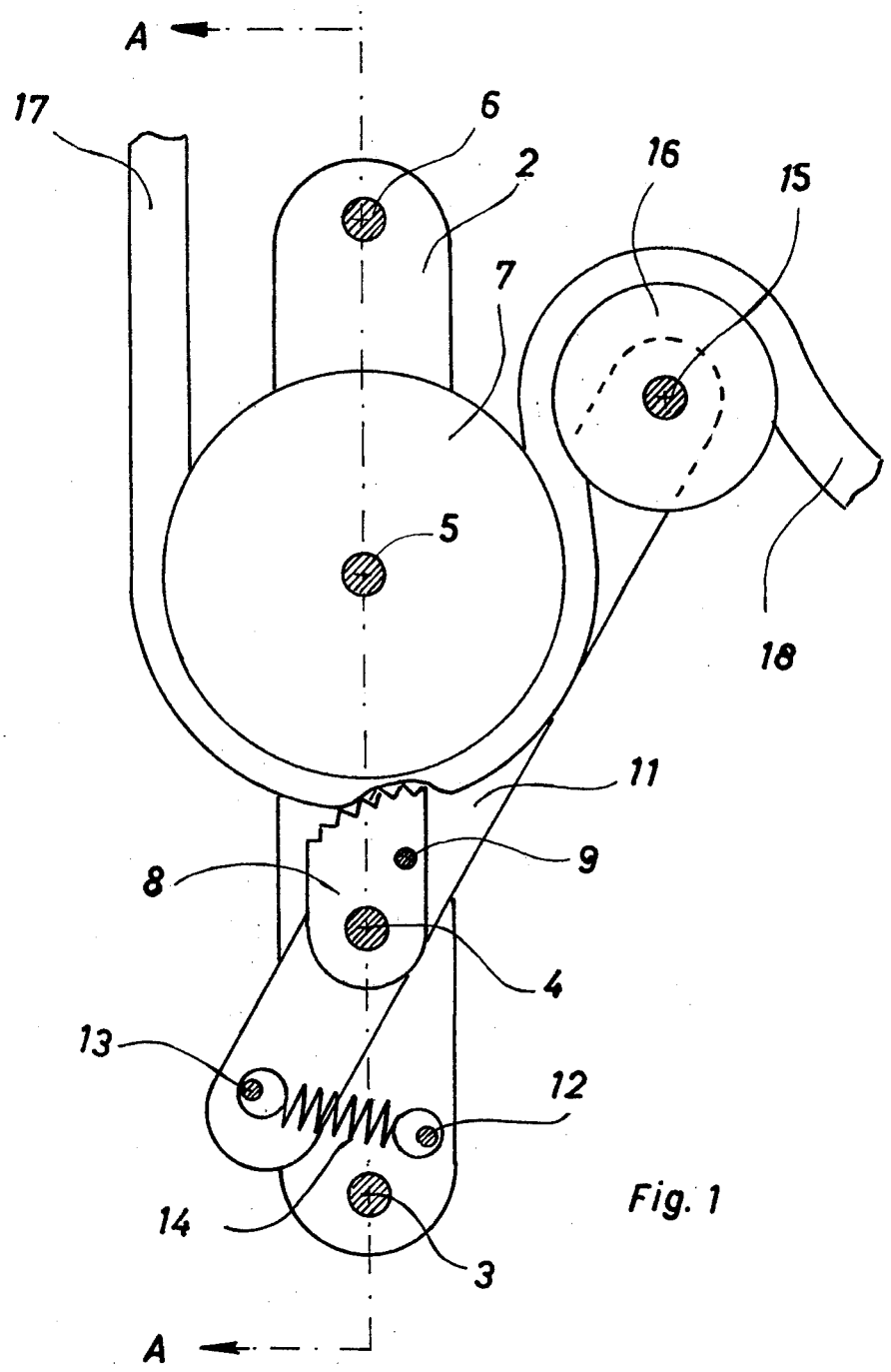
FIG. 1 is a side elevational view, with some of the elements on the near side of the apparatus removed, of a first embodiment of rope clamping means according to the invention in the rope clamped condition.
Figure 2:
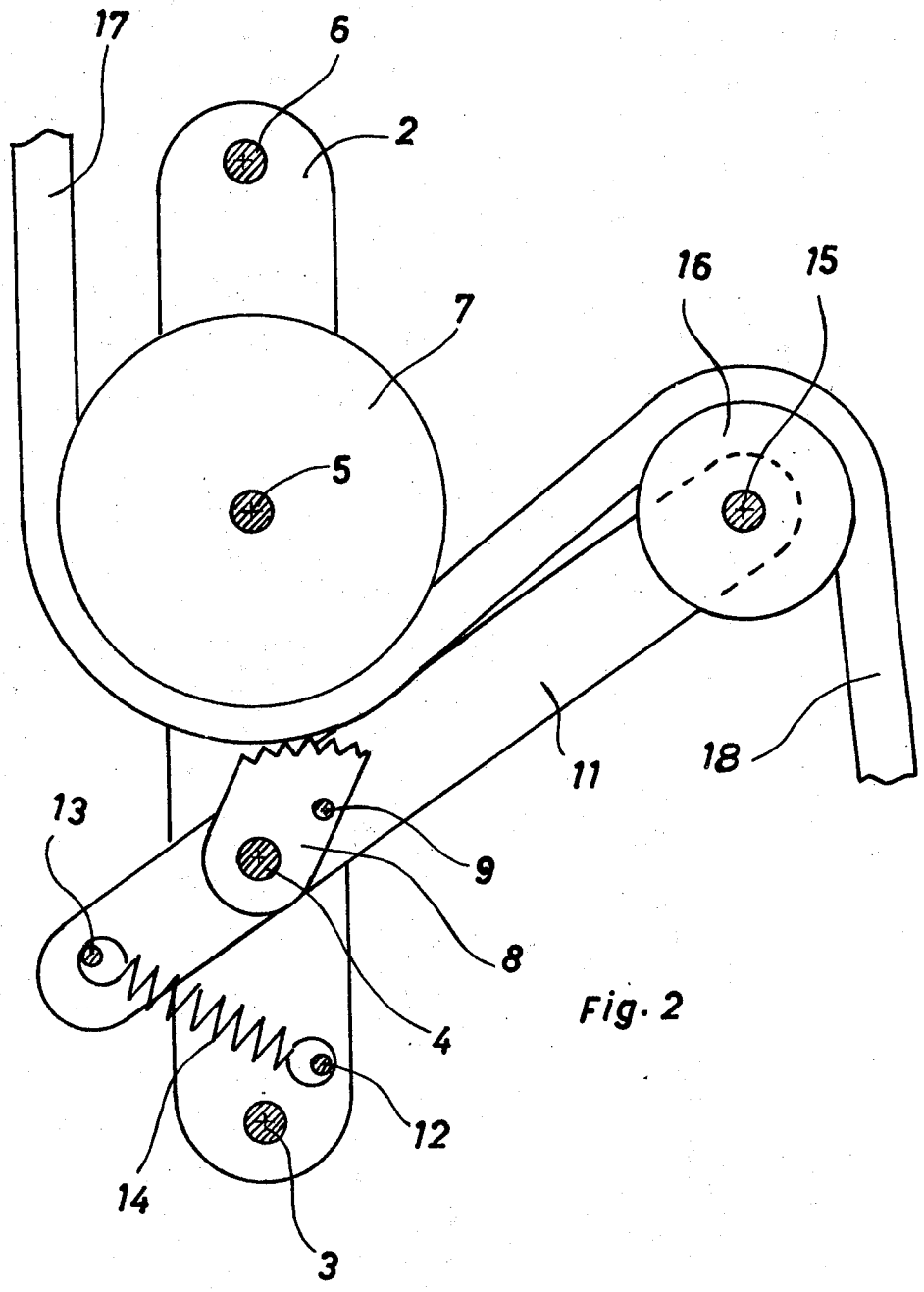
FIG. 2 is the same type of view as FIG. 1, with the apparatus in the rope released condition.
Figure 3:
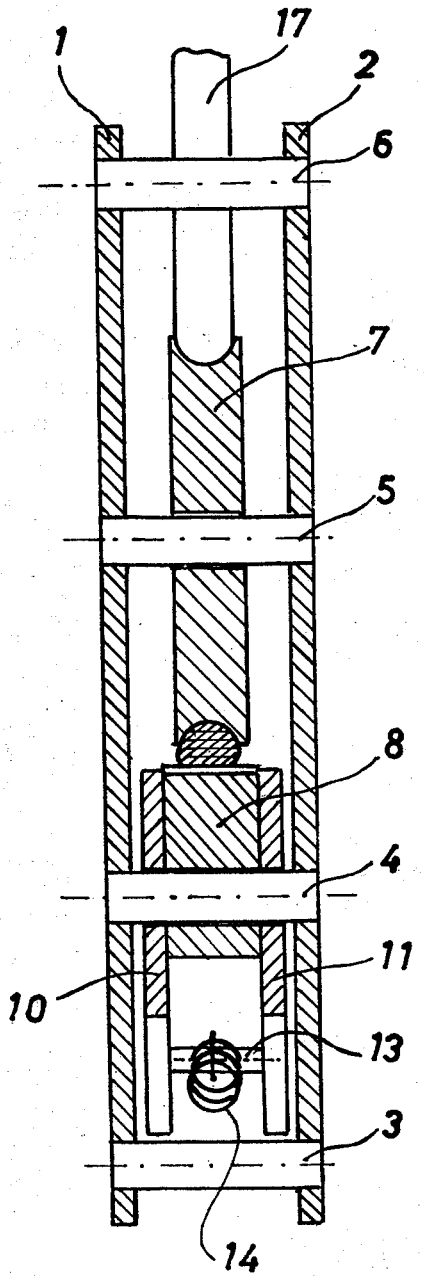
FIG. 3 is a cross-sectional view of a complete apparatus of FIG. 1 along the line and in the directions of arrows A—A.

In the first embodiment of FIGS. 1–3, the clamping means is placed between two outer walls 1 and 2 of a pulley or roller block. The walls 1 and 2 of the block are fixedly secured together and are fixedly spaced apart by fixed pins 3, 4, 5 and 6. Pin 3 would also serve to secure the block and the clamping means to another apparatus, such as the deck of a boat (not shown). To pin 6 may be secured, as a particular installation requires, an additional block or clamping means of the type disclosed herein or of another type. The pin 6 may be secured to a part of an apparatus which holds the wall 1 and 2 in the upright condition illustrated in the drawings.

A roller or pulley 7 is rotatably mounted on pin 5. The roller 7 serves as a bearing about which the rope or sheet moves. Other appropriate bearings, even including a projection or abutting surface secured to the walls 1 and 2, could serve the function of roller 7 herein. Only one roller 7 is shown. It may be the final roller in a series thereof all held in the block (and not shown). Only that roller 7 engaged by the cam 8 is significant here.

The eccentric cam 8 has a toothed bearing or clamping surface which may be pressed against the rope 17 to clamp the rope against the bearing surface of the roller 7. The cam 8 is pivotally mounted on the fixed pin 4 to be pivoted thereabout. A post 9 on the cam 8 and spaced from the fixed pin 4 engages the levers 10, 11 for causing the cam 8 to pivot around pin 4 as the levers 10, 11 pivot.

Paired levers 10, 11 are pivotally mounted also on fixed pin 4 and pivot together thereabout. The pin 9 on the cam 8 engages the levers 10, 11, whereby pivoting of the levers 10, 11 correspondingly pivots the cam 8.

A tensioned biasing spring 14 joins the peg 12 on the walls 1 and 2 with the peg 13 on the levers 10 and 11 for normally biasing the levers 10 and 11 counterclockwise in FIGS. 1 and 2, toward the position at which the cam 8 grips the rope 17, as shown in FIG. 1. Such biasing force applied to the levers 10, 11 is transmitted to the cam 8 to bias it into the rope securing position.

At the end of levers 10, 11 remote from the spring 14 is a support pin 15 about which is rotatable a rope guide pulley 16. Although a guide pulley or roller 16 is illustrated, all that is needed is some sort of bearing surface, bearing means, projection, or the like which will, when pressed by engagement of the hauling part 18 of the rope, pivot the levers 10, 11 so as to release the grip of the cam 8 on the rope 17, 18. Other and more complicated types of roller or pulley arrangements may be used in place of the roller 16.

The rope 17 has a standing part which leads from the sail or the other object which the rope is securing. The rope 17 is wound about the roller 7 where it is engaged by the cam 8, and then passes around the roller 16 to terminate in the hauling portion 18 of the rope, which is normally not tensioned. The hauling portion is held by the hand of the operator when it is desired to haul upon or to release or slacken the rope 17. The constant stress on the standing part of the rope keeps the cam 8 in secure engagement with the rope 17 against the roller 7.

To tighten the rope 17, as one would do when raising a sail, the operator hauls on the hauling part 18 of the rope. This pulls down upon the roller 16, pivots the levers 10, 11 clockwise in FIG. 1, pivots the cam 8 off the rope 17 and frees the rope to be tightened. When hauling on the rope is completed, the operator may gradually release the pulling force on the hauling part 18 or he may even just simply drop his grip of the rope. The spring 14 immediately biases the levers 10, 11 counterclockwise, which correspondingly moves the cam 8 counterclockwise until its upper clamping surface firmly grasps the rope 7 and prevents its subsequent release or slackening. The shape of the clamping surface of the cam 8 and the placement of the cam with respect to the roller 7 assures that as the pulling force on the standing part of the rope 17 increases, the cam 8 will engage the rope correspondingly more tightly.

To release, slacken or ease the rope or sheet 17, as when a sail is lowered, the operator lightly hauls on the hauling part 18 of the rope. The operator must overcome the biasing force of the spring 14 and whatever gripping force the cam 8 exerts against the roller 7 and the rope 17. But, the lever arm of the levers 10, 11 from the pulley 16 to the pivot 4 is considerably longer than the lever arm from the pivot 4 to the clamping surface of the cam 8 and the biasing force of the spring 14 need not be very large, whereby the operator pulling upon the hauling part of the rope 18 has considerable mechanical advantage in his favor and need not pull very hard upon the hauling part of the rope to release the rope from the grip of the cam 8. When the operator pulls on the hauling part of the rope 18, the levers 10, 11 and the cam 8 pivot clockwise from their position of FIG. 1 to their position of FIG. 2. The rope remains unclamped, so long as sufficient pulling force is exerted upon the rope to hold the levers 10, 11 in their position of FIG. 2. Now the operator still holds the rope 17 but allows it to slip through his hands or otherwise permits it to slacken or ease off to the desired extent. So long as a sufficient restraint or pulling force is exerted on the hauling part 18, the clamping cam 8 stays open and the rope 17 can be eased off, as would occur with a sail being lowered.

When the hauling part is completely released, the spring 14 draws the levers 10, 11 counterclockwise and moves the cam counterclockwise back to clamp the rope 17 and prevent it from further slackening or easing off. The operator need not be concerned with any further slackening or easing off of rope 17 or with the undesired lowering of a sail held by the rope or sheet 17.

As can be seen from a comparison of FIGS. 1 and 2, in the first embodiment the roller 16 swings through a relatively large arc, whereby the operator has to draw a relatively large amount of the hauling part of the rope 18 before the cam 8 releases the rope 17.

Figure 6:
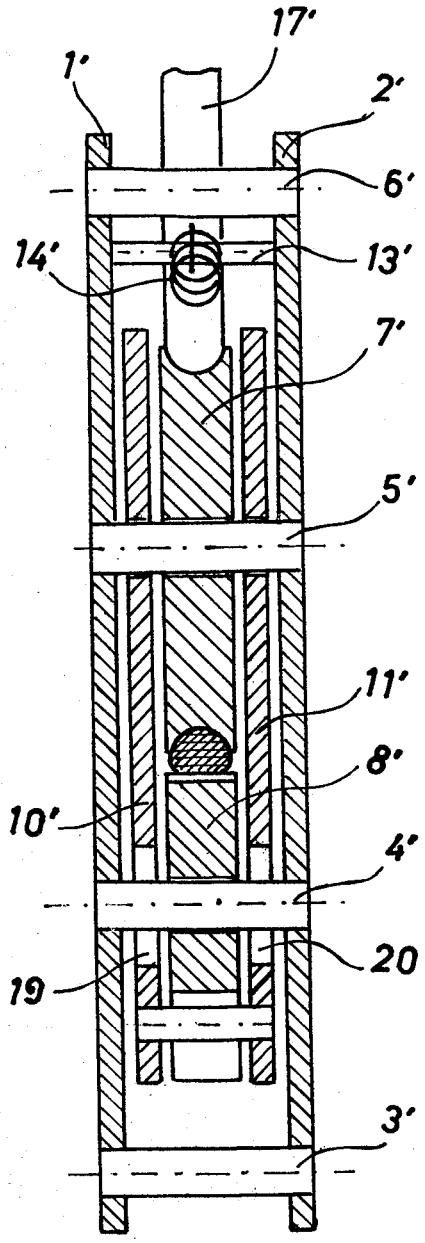
FIG. 6 is a cross-sectional view of a complete apparatus of FIG. 4 along the line and in the direction of arrows B—B.
Figure 4:
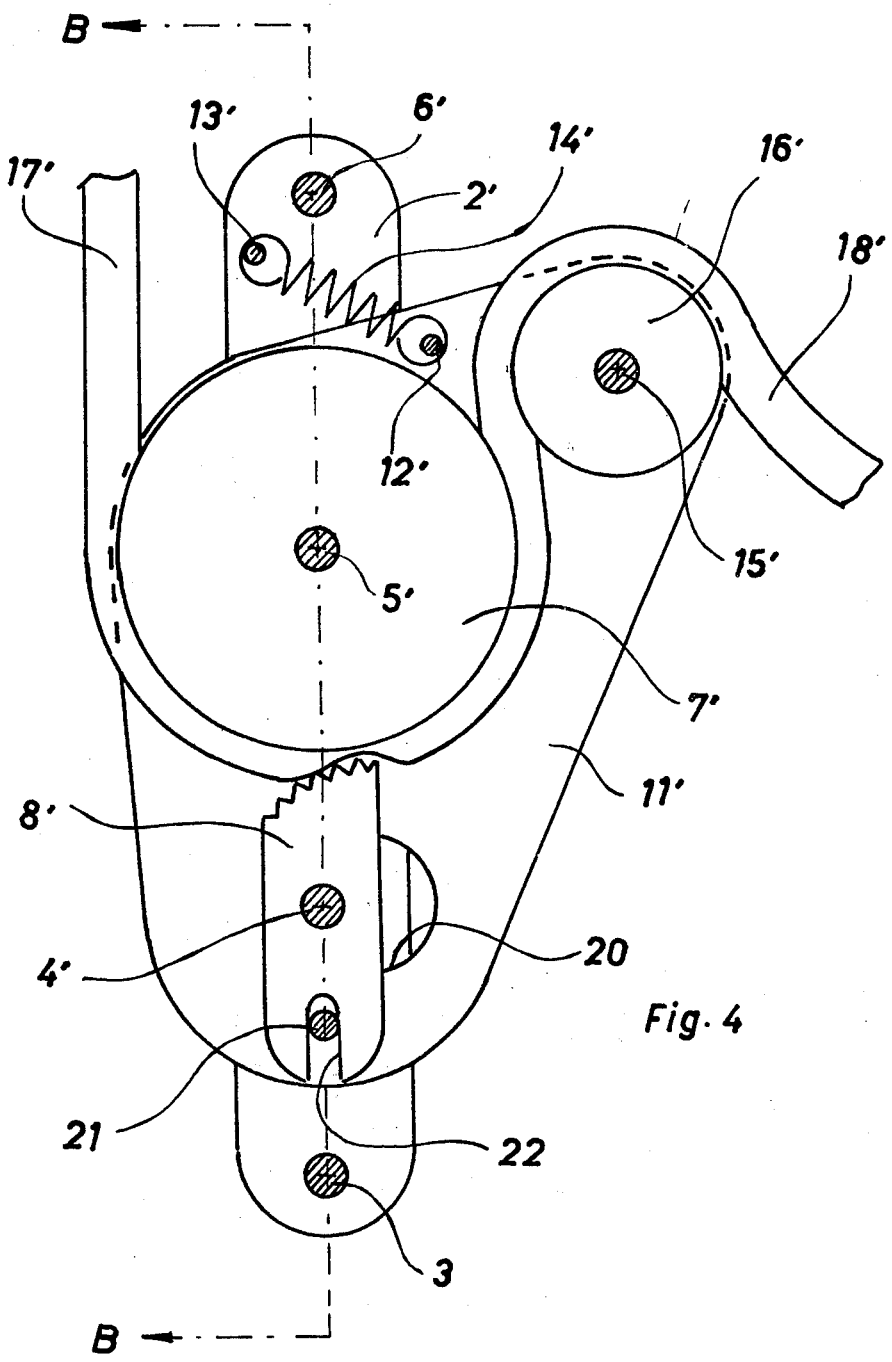
FIG. 4 is a side elevational view, with some of the elements on the near side of the apparatus removed, of a second embodiment of rope clamping means according to the invention in the rope clamped condition.
Figure 5:
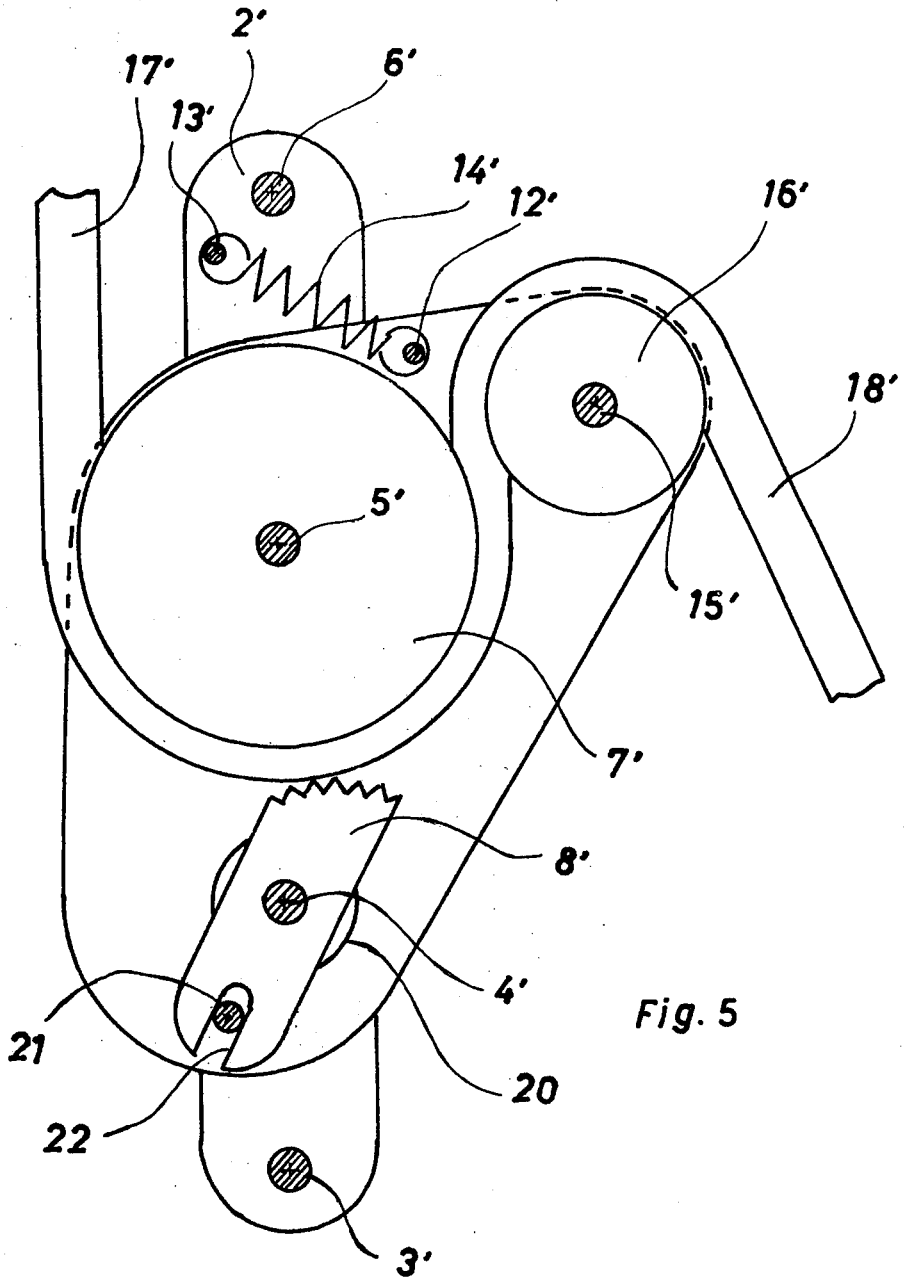
FIG. 5 is the same type of view as FIG. 4, with the apparatus in the rope released condition.

In the second embodiment of FIGS. 4–6, the amount of the hauling part of the rope the operator must pull before the rope is released from the clamping action is considerably smaller. In FIGS. 4–6, parts analogous to those of the first embodiment of FIGS. 1–3 are correspondingly numbered, with the reference numerals marked with a prime (′). The description of corresponding elements of the first embodiment is incorporated by reference in the description of the second embodiment.

The levers 10′, 11′ are illustrated as having a large, generally triangular, shape, with their contour encompassing all of rollers 7′ and 16′ and cam 8′. The levers 10′, 11′ are pivotable about the pin 5′ of the roller 7′, instead of the pin 4′ as in the first embodiment. The cam 8′ is still pivotable about the pin 4′.

To accommodate the pivoting motion of the levers 10′, 11′ with respect to the stationary pin 4′, the levers 10′, 11′ have respective openings 19, 20, which are of a size sufficient to permit the levers 10′, 11′ to swing about their pivot 5′ without interference from the pin 4′ (except, perhaps, at the ends of the strokes of the levers 10′, 11′, where further pivoting in either direction is no longer desired).

Instead of the pin 9 on the cam of the first embodiment, which engages the pivoting levers thereof, there is a pin 21 on the levers 10′, 11′ which is received in a slit 22 formed in from the bottom of the cam 8′. As the levers 10′, 11′ pivot about the pivot pin 5′, the pin 21 pivots the cam 8′ about its pivot pin 4′, bringing about the same engagement and release of the rope 17′ as occurred in the first embodiment.

Because of the differences in the lengths of the lever arm between the pivot 5′ and the pin 21 of the levers 10′, 11′, on the one hand, and the pivot 4′ and the pin 21 of the cam 8′, on the other hand, the pivoting motion of the levers 10′, 11′ is magnified in the corresponding pivoting motion of the cam 8′, whereby only a small pivoting angle of the levers 10′, 11′ is needed to cause the clamping surface of the cam 8′ to release and engage the rope 17′. Further, the magnified motion of the cam 8′ assures that the rope 17′ will be rapidly reengaged by the cam 8′, when the hauling part 18′ of the rope is released, whereby a minimal length of the rope will return or be run off when the rope is released.

The second embodiment, therefore, differs principally from the first embodiment in that the different pivots for the levers 10′, 11′ and the cam 8′ magnify the angular movement of the cam 8′ as compared with the angular motion of the levers 10′, 11′.

The third embodiment of FIGS. 7–10 is a modification of and uses a similar principle of operation to the arrangement of the first embodiment. Elements in the third embodiment analogous to those in the first embodiment are numbered correspondingly. The description of corresponding elements of the first embodiment is incorporated by reference in the description of the third embodiment.

Figure 7:
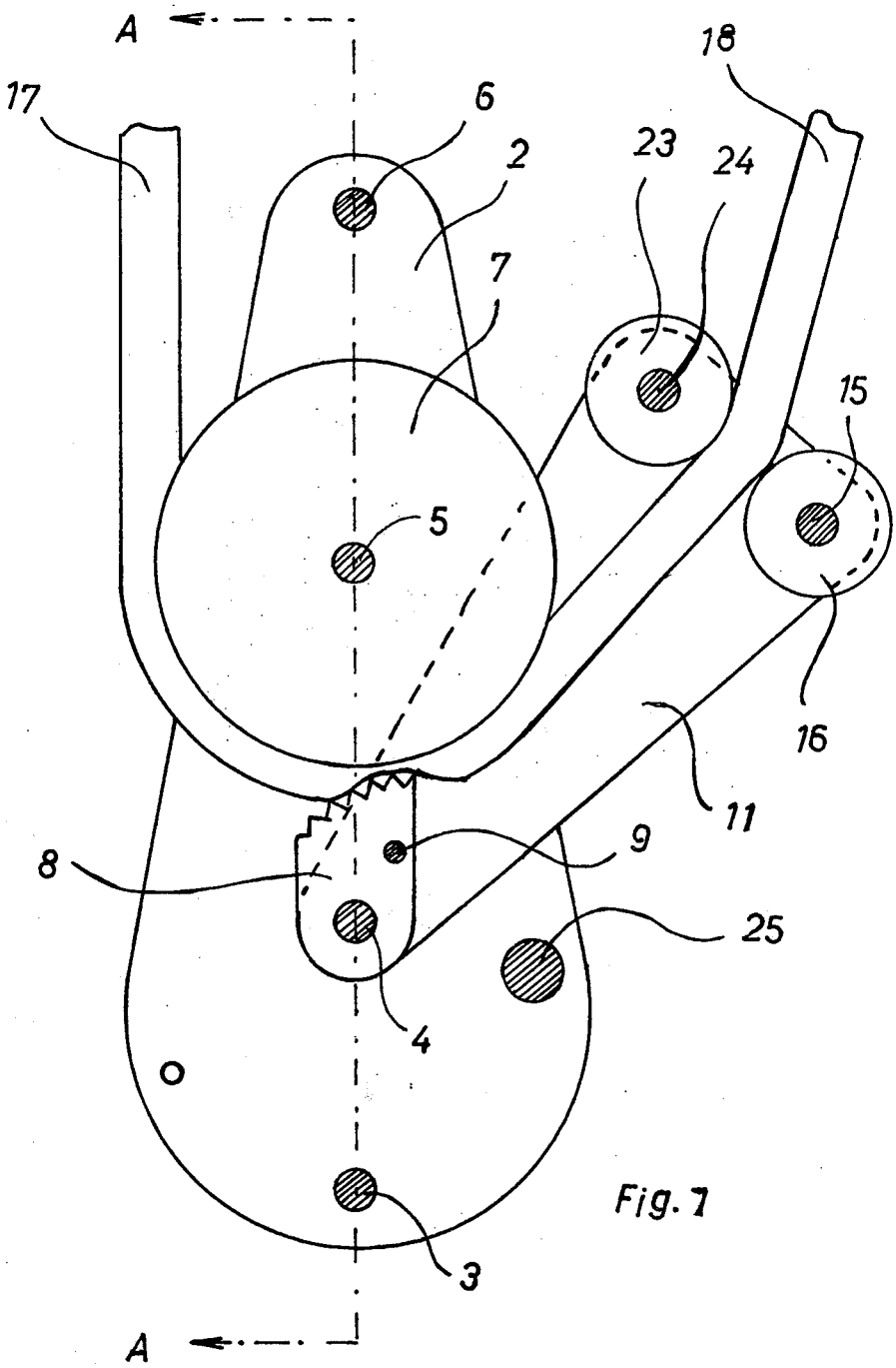
FIG. 7 is a side elevational view, with some of the elements on the near side of the apparatus removed, of a third embodiment of rope clamping means according to the invention in the rope clamped condition.

Referring to FIG. 7, the hauling part 18 of the rope is shown extending in a direction which would normally bias the eccentric cam 8 to clamp the rope 17.

In this embodiment, instead of there being a single roller 16, there are two cooperating rollers or pulleys 16 and 23, with the latter roller being rotatably carried upon the pivot pin 24 on the levers 10, 11 and with the rollers being spaced apart so as to hold the rope 17 between them. The rollers 16 and 23 guide the hauling part of the rope 18, no matter whether it is pulled upwardly, as shown in FIG. 7, or it is pulled downwardly, as shown in FIG. 8.

Figure 9:
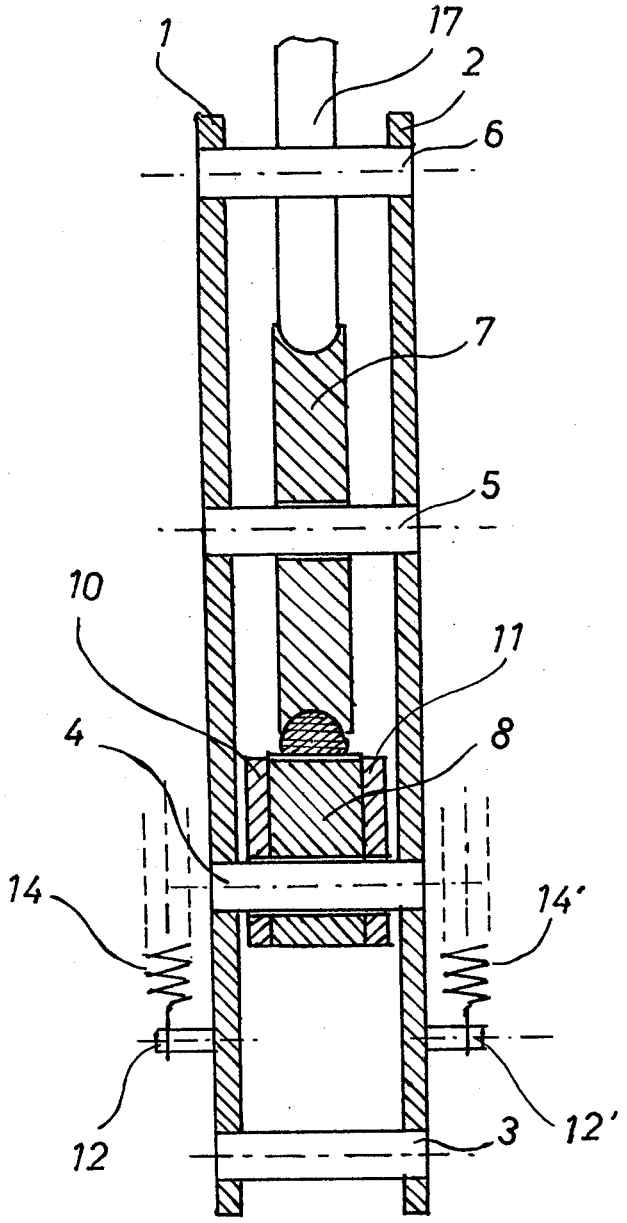
FIG. 9 is a cross-sectional view of a complete apparatus of FIG. 7 along the line and in the direction of arrows C—C.
Figure 10:
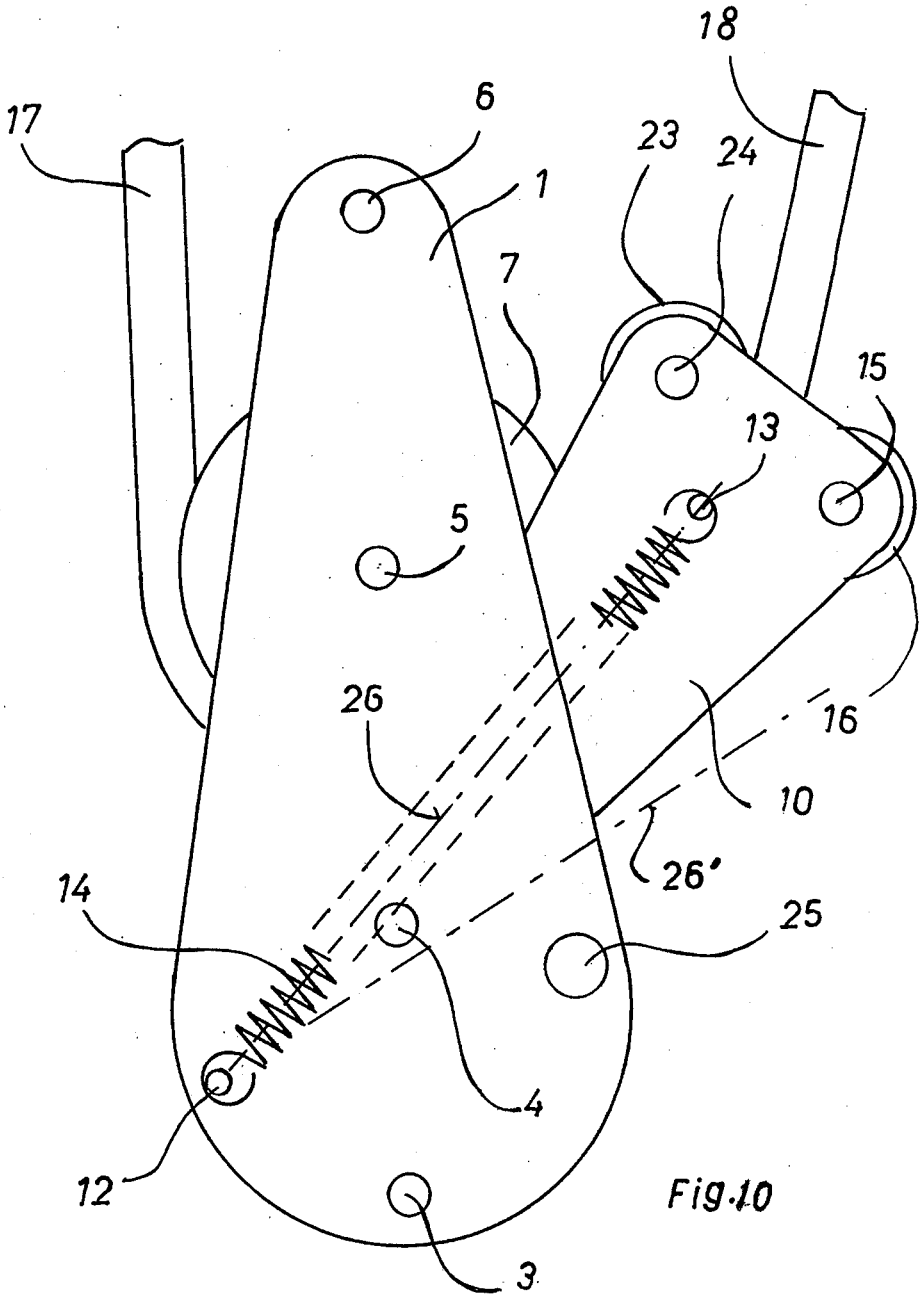
FIG. 10 is a side elevational view of the apparatus of FIG. 7 in the condition of FIG. 7, with all of the elements of the apparatus in place.

In the third embodiment, there is an over center spring type arrangement for moving the levers 10, 11 and the cam 8 between the terminal points of their rope clamping and releasing motions. Referring to FIGS. 9 and 10, the spring 14 extends from the walls 1 and 2 at one side of the pivot pin 4 to the levers 10, 11 at the other side of the pivot pin 4 and the spring thus crosses the pivot for the levers and the cam.

The center line 26 of the spring 14 moves from the upper position shown in FIG. 10, which is one over center terminal position, to the lower position marked 26′ in FIG. 10, which is the other over center position of the spring 14. The spring cuts the axis of the pin 4 at the dead center (maximum extension) of the spring 14, whereby the spring 14 causes the levers 10, 11 to snap to their terminal positions at the spring center line positions 26 and 26′. Because the spring 14 swings across the pin 4, the spring 14 is supported outside the walls 1, 2 of the block, so that the pin 4 would not interfere with this motion.

Figure 8:
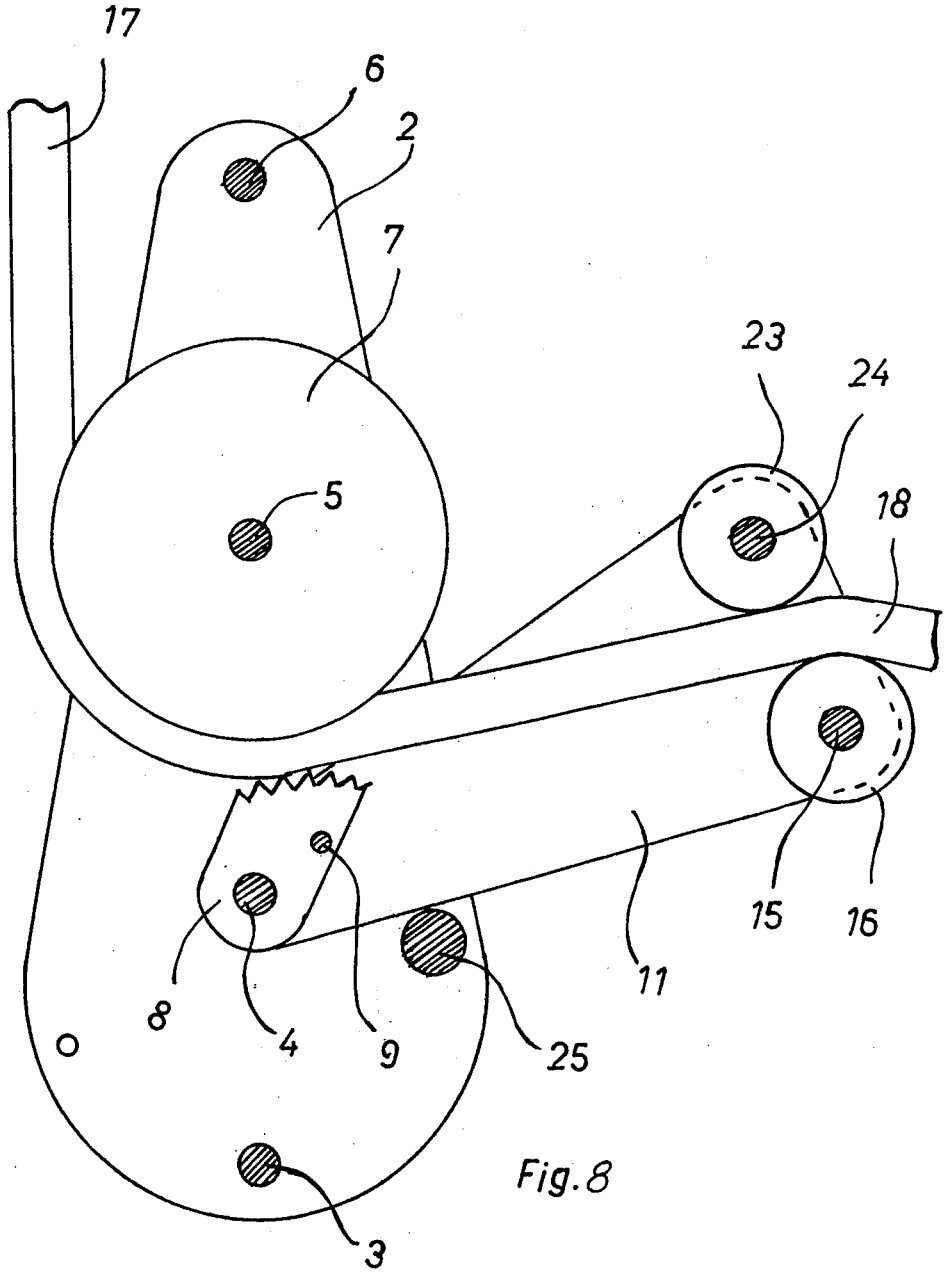
FIG. 8 is the same type of view as FIG. 7, with the apparatus in the rope released condition.

Referring to FIG. 8, when an operator wishes to pull the rope 17 tighter or to release the rope, he pulls upon the hauling part of the rope 18 and in a direction which wraps the rope 17 around the roller 16, so that the rope 17 pivots the levers 10, 11 clockwise around their pivot 4. The overcenter spring 14 (not shown in FIG. 8) moves the levers 10, 11 clockwise until the levers engage the abutment 25 affixed on the walls 1, 2. The abutment 25 determines the limit of the clockwise pivoting of lever 10, 11.

It is apparent that either or both of the rollers 16, 23 may be replaced with an appropriate sliding or bearing surface, the rollers having been provided to ease the motion of the rope 17, 18.

Figure 11:
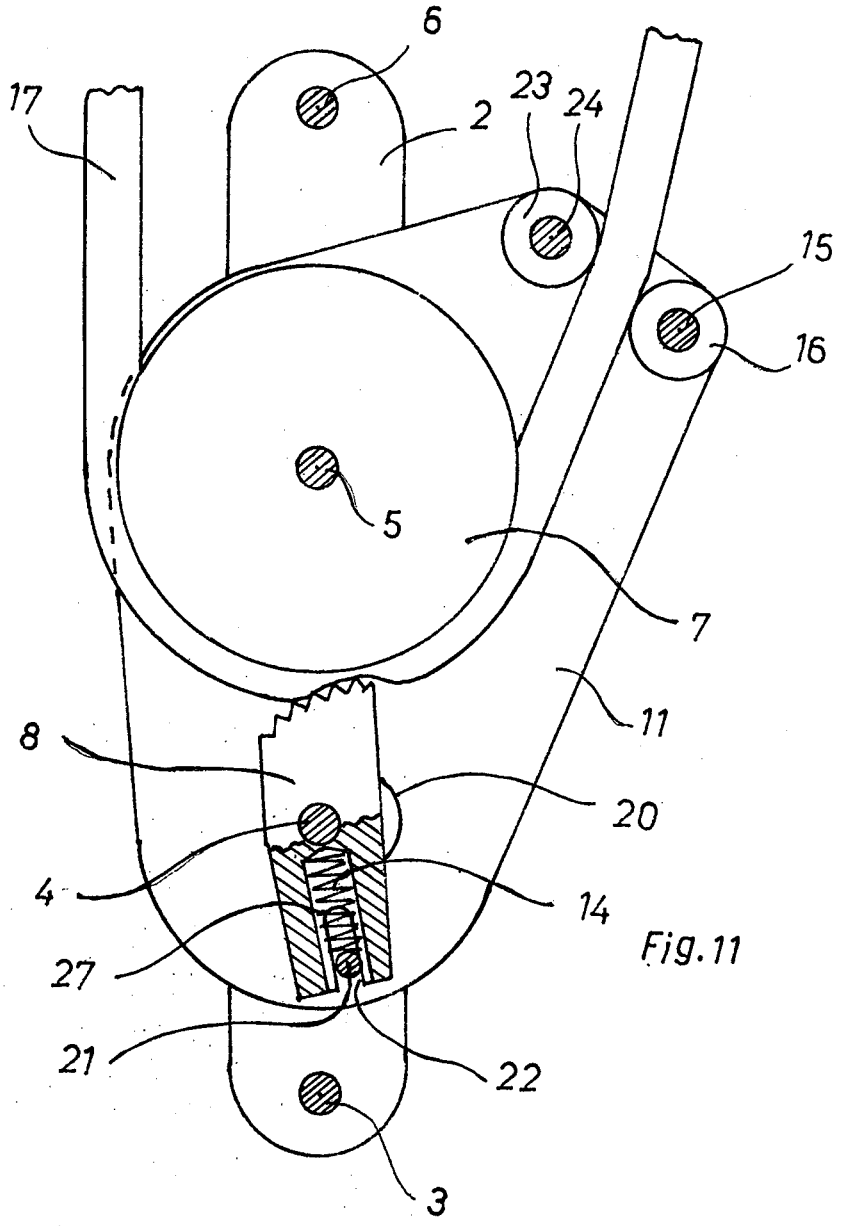
FIG. 11 is a side elevational view, with some of the elements on the near side of the apparatus removed, of a fourth embodiment of rope clamping means according to the invention in the rope clamped condition.
Figure 12:
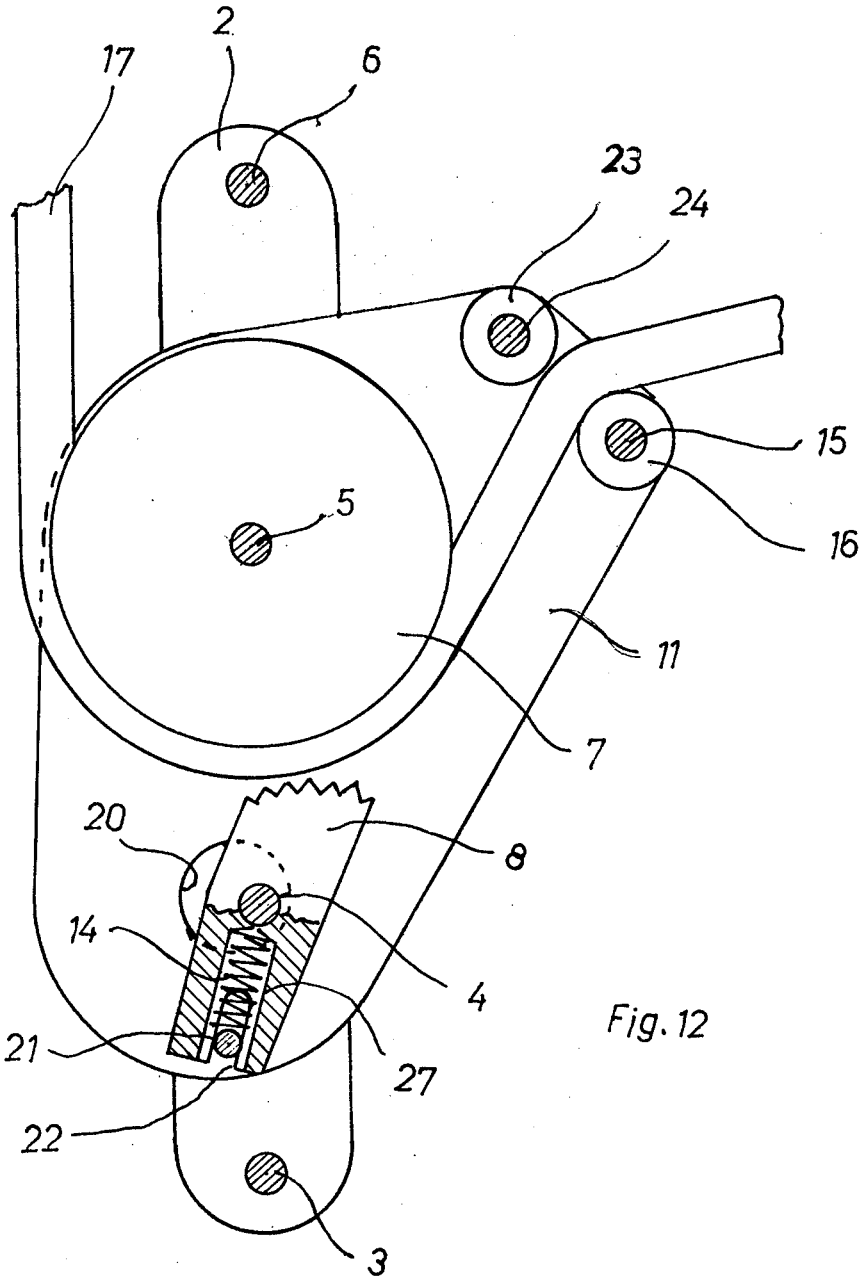
FIG. 12 is the same type of view as FIG. 11, with the apparatus in the rope released condition.

The fourth embodiment of FIGS. 11 and 12 is a modification of the second embodiment of FIGS. 4 and 5, and further modified with the over center feature of the third embodiment of FIGS. 7–10. Elements in FIGS. 11 and 12 which are analogous to those in FIGS. 4 and 5 of the second embodiment and FIGS. 7–10 of the third embodiment are correspondingly numbered without the prime (′). In the cases where elements have been previously described, their description is not repeated here, but is instead incorporated by reference from the previous descriptions thereof.

Referring to FIGS. 11 and 12, the cam 8 includes the slit 22 into its bottom for receiving the pin 21 on the levers 10, 11. In addition, there is a hole 27 leading into the cam 8 from the slit 22. The spring 14 is located inside the hole 27. At one end, the spring 24 pushes against the bottom wall of the hole 27. At the other end, the spring 14 pushes against the pin 21 on the levers 10, 11.

In the fourth embodiment, although the spring 14 is within a hole inside the cam 8, the cam is, in turn, attached to the pivot pin 4 on the walls 1, 2 of the frame. In pressing against the bottom of the hole in the cam 8, the spring 14 is, in effect, pressing against the pin 4 and thus against the walls 1, 2. Thus, in the fourth embodiment, as in the other embodiments, the spring 14 presses against the block 1, 2 at one end and against the levers 10, 11, by pin 21, at the other end.

The end of the hole 27 and thus the direction of extension of the spring 14 is such that it extends radially across the arcuate pathway traveled by the cam 8 and the levers 10, 11, whereby the over center biasing of cam 8 may be realized.

The cam 8 and/or the hole 27 therein are angled such that as the cam 8 and the levers 10, 11 move from one respective terminal position toward their other respective terminal position, the spring 14 is compressed to maximum compression as the cam 8 moves to the dead center position. Once the cam 8 and levers 10, 11 are over center in either direction, the spring 14 forces the cam 8 and the levers 10, 11 to their nearest terminal positions.

The borders of the holes 20 in the walls 10, 11 perform the function of the pin 25 in FIGS. 7–10 and define the limits of motion of the levers 10, 11 and the cam 8 around the pin 5 and with respect to the stationary pin 4.

FIG. 11 illustrates the condition of the cam 8 when it is holding the rope 17. FIG. 12 indicates the position of the cam when it has been pivoted by the pivoting of the lever 10, 11 clockwise around the pivot 5. The operations upon the rope with respect to the elements of the fourth embodiment has been described in connection with the earlier embodiments.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

What is claimed is:

1. Rope clamping arrangement, comprising:

a block;

a lever pivotally attached on said block at a first pivot mount and pivotable with respect to said block between a first and a second lever pivot position;

a cam pivotally attached on said block at a second pivot mount spaced from said first pivot mount, and pivotable with respect to said block between a third and fourth cam pivot position;

a pin on said lever and a slit in said cam in which said pin is received, whereby said slit guides said pin and said pin is moved by said lever and, in turn, moves said cam; said pin and said slit being generally at one side of said second pivot mount and said first pivot mount being at the opposite side of said second pivot mount; said cam thereby being connected to said lever such that pivoting of said lever to its said first position pivots said cam to its said third position and pivoting of said lever to its said second position pivots said cam to its said fourth position;

said cam having a clamping surface;

biasing means for biasing said cam to said third position;

a rotatable roller supported to rotate on said block; said roller having a periphery which is located at a position between said first and said second pivot mounts; said cam clamping surface being so positioned that when said cam is pivoted to its said third position, its said clamping surface presses a rope against said roller periphery.

2. Rope clamping arrangement, comprising:

a block;

a lever pivotally attached on said block at a first pivot mount and pivotable through a pivot arc with respect to said block between a first and a second lever pivot position;

a cam pivotally attached on said block at a second pivot mount spaced from said first pivot mount, and pivotable with respect to said block between a third and fourth cam pivot position;

a pin on said lever and a slit in said cam in which said pin is received, whereby said slit guides said pin and said pin is moved by said lever and, in turn, moves said cam;

biasing means for biasing said cam to said third position;

said slit being elongated sufficiently to receive said biasing means and said biasing means extending between said pin and an end of said slit which is generally radially spaced, with respect to said pivot arc of said lever, away from said pin;

said biasing means includes an over center spring, which has its point of maximum biasing force between said cam third and fourth pivot positions, and once said spring has passed its said point of maximum biasing force, said spring biases said cam to the respective one of said third and fourth positions toward which said cam has already been moved;

said pin and said slit being generally at one side of said second pivot mount and said first pivot mount being at the opposite side of said second pivot mount; said cam thereby being connected to said lever such that pivoting of said lever to its said first position pivots said cam to its said third position and pivoting of said lever to its said second position pivots said cam to its said fourth position;

said cam having a clamping surface;

a rotatable roller supported to rotate on said block; said roller having a periphery which is located at a position between said first and said second pivot mounts; said cam clamping surface being so positioned that when said cam is pivoted to its said third position, its said clamping surface presses a rope against said roller periphery.

3. Rope clamping arrangement, comprising:

a block;

a lever pivotally attached on said block at a pivot mount and pivotable through a pivot arc with respect to said block between a first and a second lever pivot position;

a cam connected to and pivotable with respect to said block between a third and fourth cam pivot position; said cam being connected to said lever such that pivoting of said lever to its said first position pivots said cam to its said third position and pivoting of said lever to its said second position pivots said cam to its said fourth position;

said cam having a clamping surface;

biasing means for biasing said cam to said third position;

a pin on said lever and a slit in said cam in which said pin on said lever is received, whereby said slit guides said pin and said pin is moved by said lever and, in turn, moves said cam;

said slit being elongated sufficiently to receive said biasing means and said biasing means extending between said pin and an end of said slit which is generally radially spaced, with respect to said pivot arc of said lever, away from said pin;

first bearing means supported on said block at a position such that when said cam is pivoted to its said third position, its said clamping surface presses a rope against said first bearing means;

said biasing means includes an over center spring, which has its point of maximum biasing force between said cam third and fourth pivot positions, and once said spring has passed its said point of maximum biasing force, said spring biases said cam to the respective one of said third and fourth positions toward which said cam has already been moved.

* * * * *